US007441765B2

(12) United States Patent
Okamoto

(10) Patent No.: US 7,441,765 B2
(45) Date of Patent: Oct. 28, 2008

(54) SHEET FEEDING MECHANISM

(75) Inventor: Tsugio Okamoto, Kani (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/879,179

(22) Filed: Jun. 30, 2004

(65) Prior Publication Data

US 2005/0023744 A1 Feb. 3, 2005

(30) Foreign Application Priority Data

Jun. 30, 2003 (JP) ..... 2003-186654

(51) Int. Cl.
*B65H 3/52* (2006.01)

(52) U.S. Cl. ..... 271/121; 271/167

(58) Field of Classification Search ..... 271/113, 271/121, 167

See application file for complete search history.

(56) References Cited

U.S. PATENT DOCUMENTS 4,436,298 A * 3/1984 Donner et al. ..... 271/10.12
4,456,238 A * 6/1984 Mizuma ..... 271/3.02
5,857,671 A 1/1999 Kato et al.
5,971,390 A * 10/1999 Caspar et al. ..... 271/121
6,086,062 A 7/2000 Nakamura et al.
6,102,389 A * 8/2000 Sakurai et al. ..... 271/121
6,267,372 B1 * 7/2001 Mylaeus et al. ..... 271/250

FOREIGN PATENT DOCUMENTS

| | | |
|---|---|---|
| JP | U-61-2339 | 1/1986 |
| JP | A-6-311367 | 11/1994 |
| JP | A-9-267944 | 10/1997 |
| JP | A-10-181910 | 7/1998 |
| JP | A 2001-354330 | 12/2001 |
| JP | A 2002-137873 | 5/2002 |
| JP | A-2002-302281 | 10/2002 |
| JP | A 2003-040467 | 2/2003 |

* cited by examiner

*Primary Examiner*—Kaitlin S Joerger
(74) *Attorney, Agent, or Firm*—Oliff & Berridge, PLC

(57) ABSTRACT

A sheet feeding mechanism comprises a sheet supporter, a pick-up roller, and a guide. The sheet supporter is capable of supporting a plurality of sheets in a stacked manner. The pick-up roller rotates in contact with a surface of, among the plurality of sheets supported by the sheet supporter, the end-most sheet in the stacking direction, to thereby pick up and convey the sheet. The guide has a surface that extends along a predetermined conveyance direction for the sheet. A line segment, between a center of the pick-up roller with respect to a direction of its rotation axis and a point at which the rotation axis intersects with the surface of the guide, forms an acute angle with a line segment extending forward in the predetermined conveyance direction from the point at which the rotation axis intersects with the surface of the guide.

8 Claims, 5 Drawing Sheets

SHEET FEEDING MECHANISM

BACKGROUND OF THE INVENTION

1. Field of the Invention

The present invention relates to a sheet feeding mechanism that is applied particularly to a recording apparatus and conveys, among a plurality of sheets supported by a sheet supporter in a stacked manner, the endmost sheet in the stacking direction.

2. Description of Related Art

A recording apparatus such as printers and facsimiles records an image on a sheet, etc., by means of its image recording head. In order to record images on a plurality of sheets in sequence, such a recording apparatus generally includes a sheet feeding mechanism that sequentially conveys, among a plurality of sheets supported by a sheet supporter in a stacked manner, the endmost sheet in the stacking direction toward the image recording head.

According to one of known sheet feeding mechanisms, a needle is stuck into an uppermost sheet supported by a sheet supporter, and in this condition the sheet is transferred to a skew correction unit (see Japanese Patent Unexamined Publication No. 2003-40467). After a skew of the sheet is corrected at the skew correction unit, the sheet is sent out toward a head. The skew correction unit includes a skew roller and a guide wall. The skew roller is slightly inclined against the direction perpendicular to a predetermined conveyance direction of the sheet. The guide wall extends in the predetermined conveyance direction. The skew roller conveys a sheet to the guide wall obliquely relative to the predetermined conveyance direction, and then one side of the sheet is laid along the guide wall, thereby implementing a skew correction. The sheet, having its skew corrected in this way at the skew correction unit, is subsequently conveyed along the predetermined conveyance direction, during which an image is recorded onto the sheet.

However, an application of the above-described sheet feeding mechanism to a recording apparatus can disadvantageously result in a size increase of the apparatus. This is because the apparatus should be provided with, in addition to the sheet feeding mechanism, the skew correction unit that includes a sheet conveyance path required for a skew correction. The path has an enough length to convey the sheet with the skew roller so that one side of the sheet is entirely laid along the guide wall).

SUMMARY OF THE INVENTION

An object of the present invention is to provide a sheet feeding mechanism that is applied particularly to a recording apparatus and capable of downsizing the recording apparatus.

According to an aspect of the present invention, there is provided a sheet feeding mechanism comprising a sheet supporter, a pick-up roller, and a guide. The sheet supporter is capable of supporting a plurality of sheets in a stacked manner. The pick-up roller rotates in contact with a surface of, among the plurality of sheets supported by the sheet supporter, the endmost sheet in the stacking direction, to thereby pick up and convey the sheet. The guide has a surface that extends along a predetermined conveyance direction for the sheet. A line segment, between a center of the pick-up roller with respect to a direction of its rotation axis and a point at which the rotation axis intersects with the surface of the guide, forms an acute angle with a line segment extending forward in the predetermined conveyance direction from the point at which the rotation axis intersects with the surface of the guide.

The above-described sheet feeding mechanism can pick up and convey the sheet, and at the same time correct a skew of the sheet. Therefore, when applying such a sheet feeding mechanism to a recording apparatus, etc., there is no need to provide the apparatus with, in addition to the sheet feeding mechanism, a skew correction unit that includes a sheet conveyance path required for a skew correction. Thus, the recording apparatus can be downsized.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a preferred embodiment of the present invention will be described with reference to the accompanying drawings.

Figure 1:
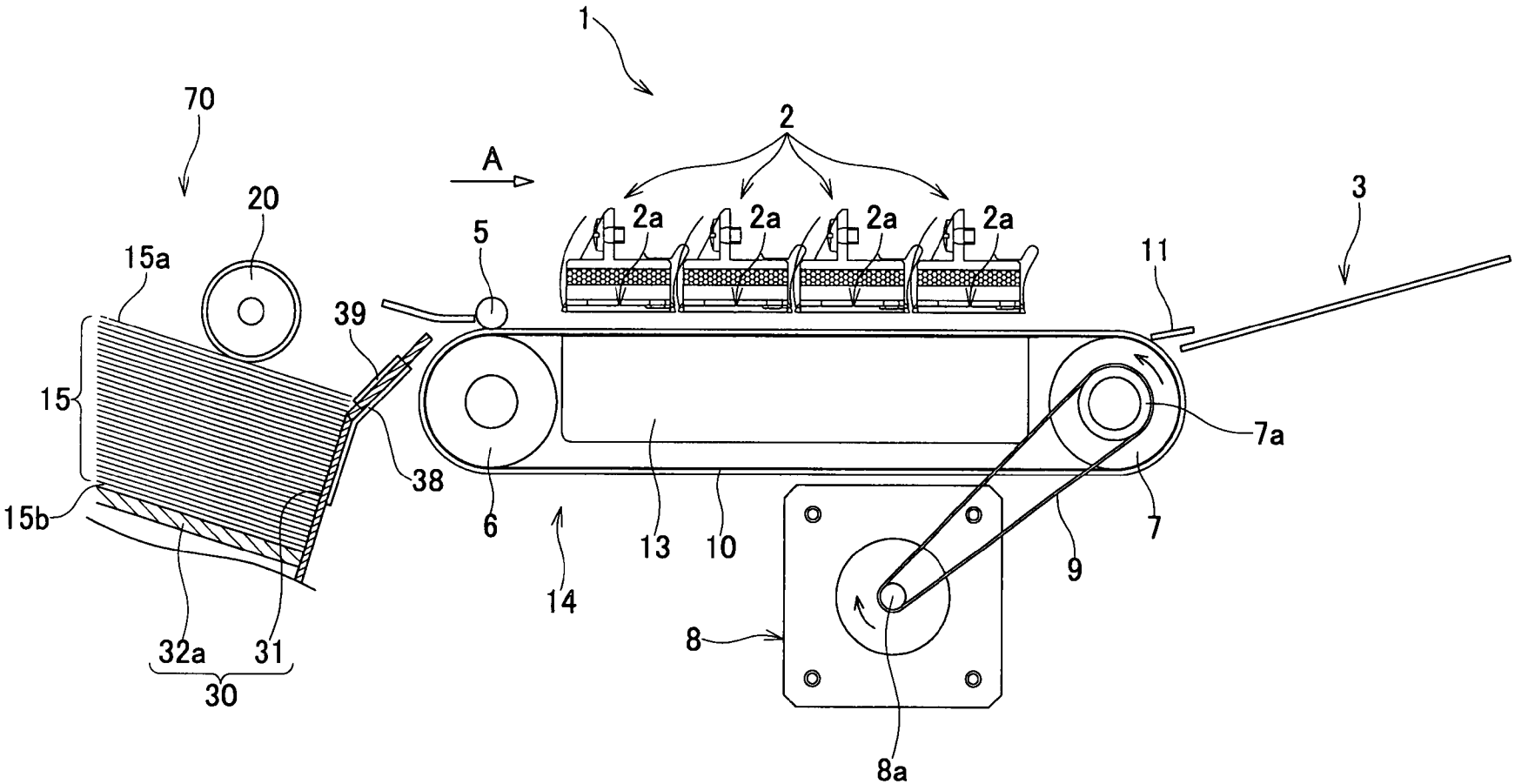
FIG. 1 is a front view of an ink-jet printer that comprises a paper feeding mechanism, a part of which is illustrated as a sectional view, acting as a sheet feeding mechanism according to an embodiment of the present invention.

First, referring to FIG. 1, a description will be given to a structure of an ink-jet printer that comprises a paper feeding mechanism acting as a sheet feeding mechanism according to an embodiment of the present invention.

A printer 1 of this embodiment is a color ink-jet printer including four ink-jet heads 2. The printer 1 further comprises, from left to right in FIG. 1, a paper feeding mechanism 70, a belt conveyor mechanism 14, and a paper discharge unit 3. Within the printer 1, formed is a paper conveyance path running from the paper feeding mechanism 70 through the belt conveyor mechanism 14 to the paper discharge unit 3. The paper conveyance path runs in a direction A, which is a predetermined conveyance direction for a paper 15 and indicated by an arrow in FIG. 1. Cut papers of various standard sizes are adoptable as the paper 15.

The paper feeding mechanism 70 comprises a casing 30 and a pick-up roller 20. The casing 30 can support a plurality of papers 15 in a stacked manner. The pick-up roller 20 is disposed above a paper storage space of the casing 30. As seen from FIG. 1, the pick-up roller 20 is positioned such that it can be in contact with a surface of, among the plurality of sheets 15, the endmost paper in the stacking direction, i.e., the direction vertically upward from a movable base plate 32*a* which will be described later. In other words, the pick-up roller 20 is positioned such that it can be in contact with a surface of, among the plurality of sheets 15, an uppermost paper 15*a*. By rotating the pick-up roller 20 that is kept in contact with the surface of the uppermost paper 15*a*, the paper 15*a* is picked up and conveyed onto a conveyor belt 10 of the belt conveyor mechanism 14.

Figure 2:
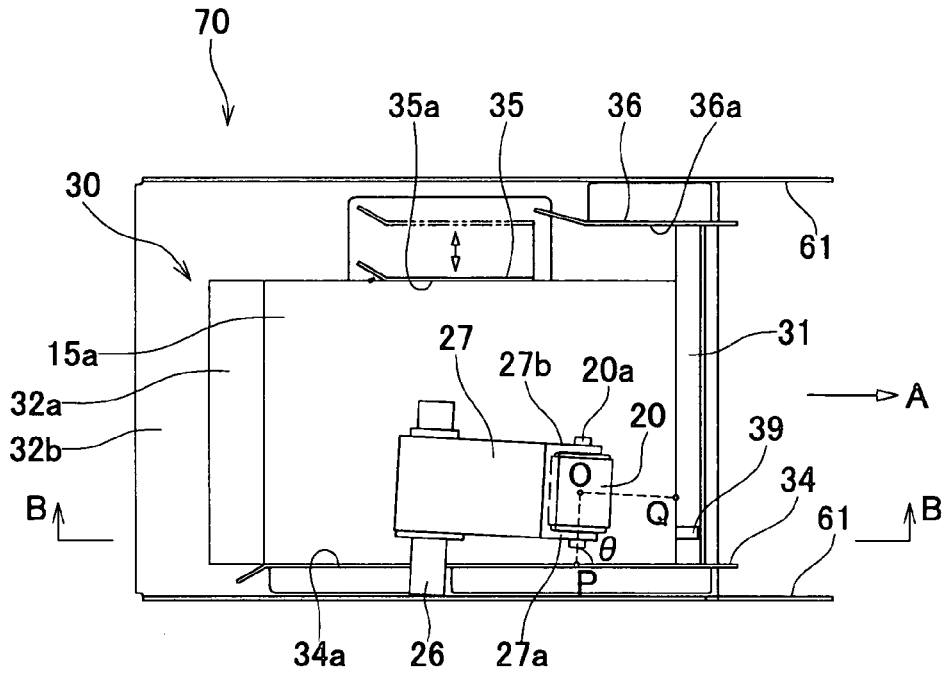
FIG. 2A is a schematic top view of the paper feeding mechanism included in the printer of FIG. 1.
FIG. 2B is a sectional view taken along a line B-B of FIG. 2A.
Figure 2:
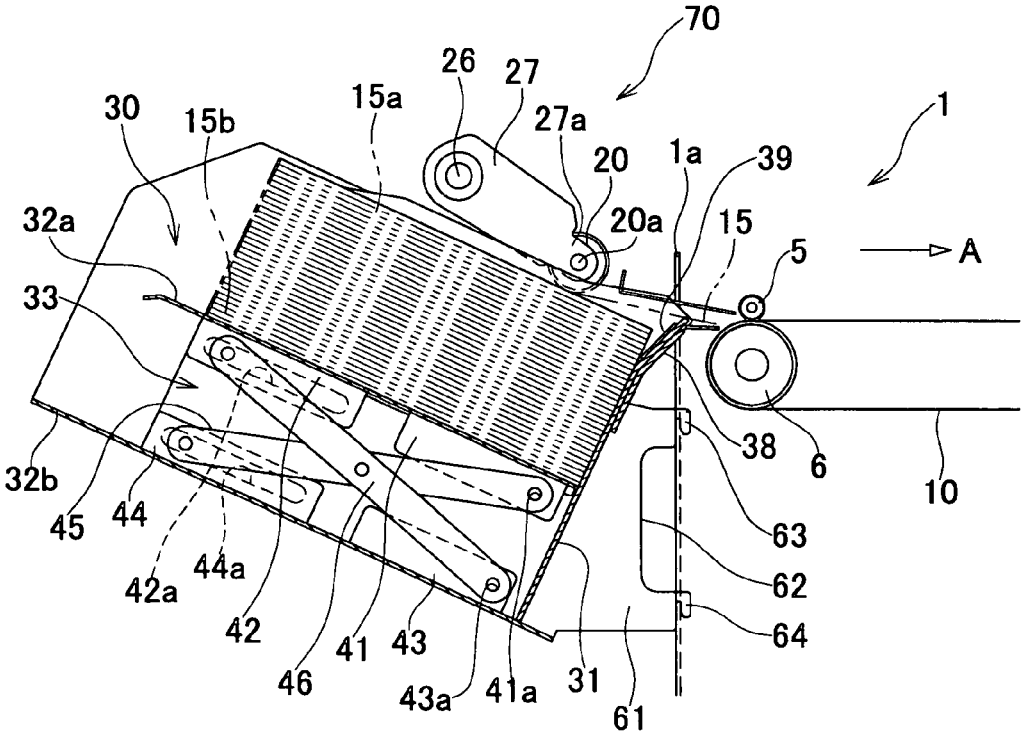

The casing 30 includes a movable base plate 32*a* and an immovable base plate 32*b* (see FIGS. 2A and 2B). The movable base plate 32*a* has substantially the same width as that of the paper, 15, and slightly larger length than that of the paper 15. The immovable base plate 32*b* is, in a plan view, somewhat larger than the movable base plate 32*a*. The casing 30 further includes a front plate 31 disposed forward in the direction A. Hereinafter, forward in the direction A will be referred to simply as "forward"; an end of the front as a "front end"; the direction reverse to the direction A as a "rear"; and an end of the rear as a "rear end".

The front plate 31 is mounted on a vicinity of a front end of the immovable base plate 32*b* so as to extend from and perpendicularly to the plate 32*b* (see FIG. 2B). The movable base plate 32*a* is in contact with a back face of a lowermost paper 15*b*-and, in this condition, supports the whole of the plurality of papers 15. A below-described elevator mechanism 33 (see FIG. 2B) disposed between the movable base plate 32*a* and the immovable base plate 32*b* enables the movable base plate 32*a* to move in the direction perpendicular to its plate plane. The front plate 31 is, at its upper side, bent forward, and a later-detailed leaf spring 38 having a friction portion 39 is mounted at the bent portion.

The belt conveyor mechanism 14 includes two belt rollers 6 and 7, a looped conveyor belt 10, and a substantially rectangular parallelepiped belt guide 13. The looped conveyor belt 10 is wrapped around the respective rollers 6 and 7 to be stretched between them. The belt guide 13 is disposed in a space enclosed by the conveyor belt 10. The belt guide 13 and the conveyor belt 10 have substantially the same width. The belt guide 13 is in contact with an inner surface of the conveyor belt 10 at an upper part thereof, and thereby supports the conveyor belt 10.

A press roller 5 is disposed opposite to one belt roller 6 that is nearer to the paper feeding mechanism 70. The paper 15 sent out of the paper feeding mechanism 70 is pressed onto an outer surface of the conveyor belt 10 by the press roller 5. The outer surface of the conveyor belt 10 is formed of a silicone rubber. The paper 15 pressed onto the outer surface of the conveyor belt 10 by the press roller 5 is held on the conveyor belt 10 with adhesive power, and in this condition the paper 15 is conveyed on.

Below the belt conveyor mechanism 14, disposed is a rotary drive 8 including a rotation shaft 8a and a drive belt 9. The drive belt 9 is stretched between the rotation shaft 8*a* of the rotary drive 8 and a shaft 7*a* of the other belt roller 7 that is nearer to the paper discharge unit 3. When the shaft 8*a* of the rotary drive 8 rotates clockwise in FIG. 1, the belt roller 7 is also rotated clockwise. This rotation of the belt roller 7 then causes the conveyor belt 10 to be driven.

In this way, the belt conveyor mechanism 14 can convey the paper 15 with the paper 15 being held on the conveyor belt 10.

A peeling plate 11 is disposed opposite to the other belt roller 7 that is nearer to the paper discharge unit 3. The paper 15 held onto the conveyor belt 10 is peeled off from the conveyor belt 10 by the peeling plate 11.

The four heads 2 are arranged adjacent to one another in the direction A. Each head 2 has, at its lower end, a head main body 2*a* formed by a passage unit and an actuator unit being laminated with each other. In the passage unit, ink passages including pressure chambers are formed. The actuator unit serves to apply pressure to ink contained in the pressure chambers. Each head main body 2*a* has a rectangular section with its length extending in parallel to a width of the conveyor belt 10, i.e., parallel to the direction perpendicularly to the drawing sheet of FIG. 1. Thus, the printer 1 is a line-type printer. A large number of nozzles (not illustrated) are formed in bottom faces of the head main bodies 2*a* confronting the paper conveyance path. The four head main bodies 2*a* eject ink of magenta (M), yellow (Y), cyan (C), and black (K), respectively.

The head main bodies 2*a* are disposed with their bottom faces being parallel to a paper conveyance face of the conveyor belt 10 and, at the same time, with a narrow clearance being formed between their bottom faces and the paper conveyance face. The paper conveyance path is formed through this clearance. While the paper 15, which is held onto the conveyor belt 10, passes immediately under the four head main bodies 2*a* in sequence, the ink of the respective colors is ejected through the corresponding nozzles toward the surface of the paper 15, to thereby record a desired color image on the paper 15.

Then, with reference to FIGS. 2A, 2B, and 3, the paper feeding mechanism 70 will be described in more detail.

The casing 30 will firstly be explained.

As illustrated in FIG. 2A, the casing 30 includes not only the above-described movable base plate 32*a*, the immovable base plate 32*b*, and the front plate 31, but also an immovable guide plate 34, a movable guide plate 35, and a maximum-width guide plate 36. The movable guide plate 35 is slidable in a widthwise direction of the paper 15. Each of the guide plates 34, 35, and 36 is a plate member with its plane laid perpendicularly to the drawing sheet of FIG. 2A. The guide plates 34, 35, and 36 have surfaces 34*a*, 35*a*, and 36*a* extending in the direction A, respectively. Each of the guide plates 34, 35, and 36 has its rear end portion bent outward for easy mounting and dismounting of the paper 15.

The immovable guide plate 34 is fixed at a position where its surface 34*a* can be contactable with one side of the paper 15 nearer to the pick-up roller 20. Sliding the movable guide plate 35 can pose the plate 35 at a position where the surface 35*a* can be contactable with the other side of the paper 15, i.e., a position where the distance between the surfaces 35*a* and 34*a* can be substantially the same as the width of the paper 15 to be used.

The immovable guide plate 34 and the paper 15 have substantially the same length, and the immovable guide plate 34 lies throughout the side of the paper 15. On the other hand, a length of the movable guide plate 35 is approximately one third of the length of the immovable guide plate 34, and the movable guide plate 35 lies substantially in the middle of the side of the paper 15. The maximum-width guide plate 36 has substantially the same configuration and the same size as those of the movable guide plate 35, and lies forward of the movable guide plate 35.

The maximum-width guide plate 36 corresponds to a paper 15 having the maximum width adoptable in the printer 1, and is fixed at a position where a distance between its surface 36*a* and the surface 34*a* of the immovable guide plate 34 can be substantially the same as the maximum width of the paper 15. Since the width of the paper 15 used in this embodiment is not the maximum width, the maximum-width guide plate 36 does not serve to settle a widthwise position of the paper 15. When the paper 15 has the maximum width, the movable guide plate 35 is positioned further away from the immovable guide plate 34 with a distance therebetween being the same as a distance between the maximum-width guide plate 36 and the immovable guide plate 34, as illustrated with chain two dashed line in FIG. 2A. Thereby, the other side of the paper 15 becomes contactable with both the surfaces 35*a* and 36*a* of the two guide plates 35 and 36.

Prior to, as will be described later, conveying the paper 15 with the pick-up roller 20, the guide plates 34 and 35 (and guide plate 36 for the maximum-width paper) hold the plurality of papers 15 from both widthwise sides to thereby settle the widthwise position of the papers 15 to a certain extent.

Figure 3:
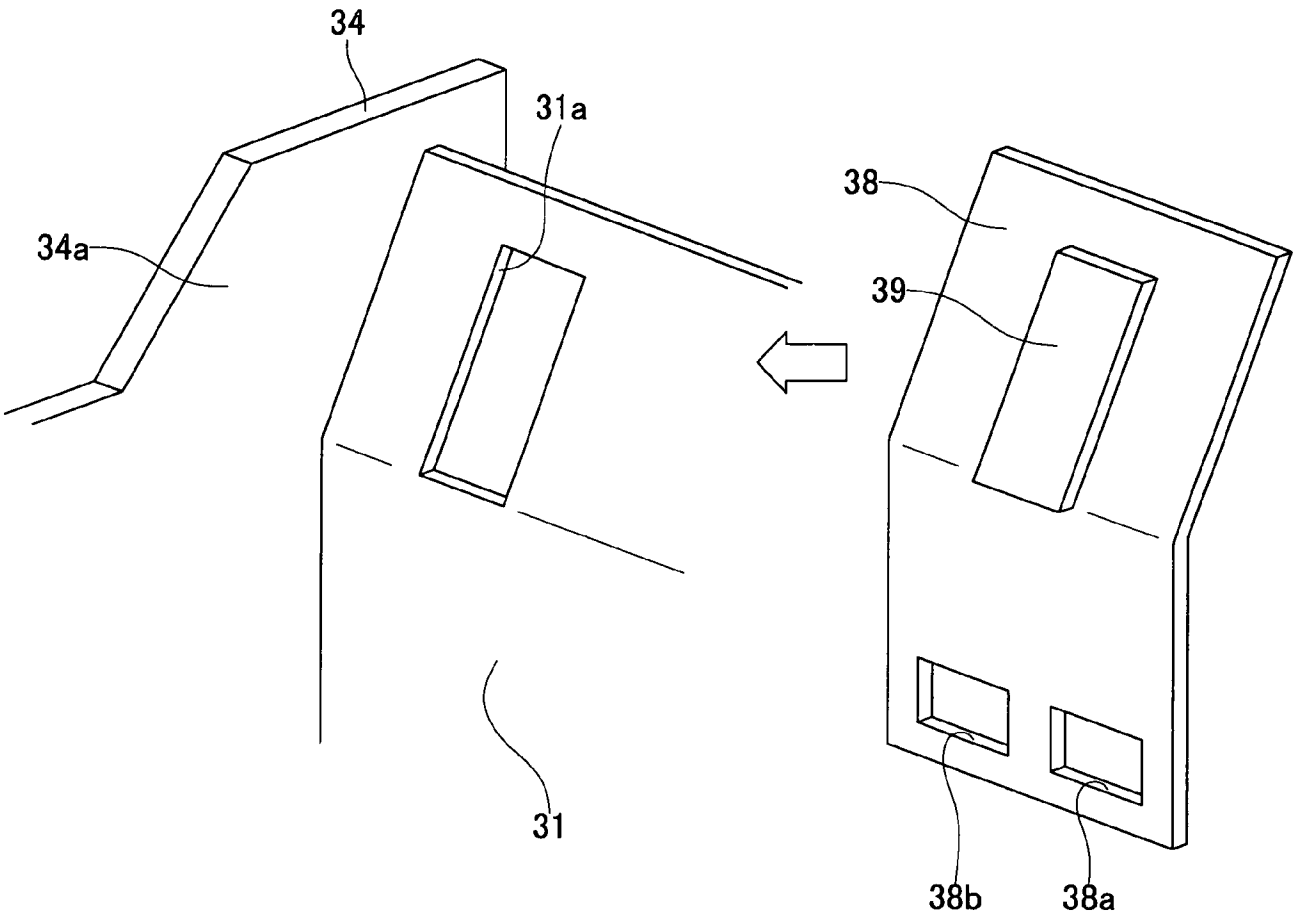
FIG. 3 is an exploded perspective view of a front plate of a casing in the paper feeding mechanism of FIG. 1, and a leaf spring having a friction portion.

As illustrated in FIG. 3, the front plate 31 of the casing 30 has, in its upper end portion that has been bent, an elongated through hole 31*a* of substantially rectangular shape. The leaf spring 38 made of an elastic member is bent in the same manner as in the upper end portion of the front plate 31. The leaf spring 38 holds, on its upper side, the friction portion 39 that has substantially the same shape as that of the through hole 31*a* and a size somewhat smaller than that of the through hole 31*a*. A coefficient of friction between the paper 15 and the friction portion 39 is higher than that between the paper 15 and the surface 34*a* of the immovable guide plate 34.

The leaf spring 38 also has, in its lower end portion, two openings 38*a* and 38*b* formed in parallel. The friction portion 39 is inserted into the through hole 31*a* and, in this condition, screws and the like are fitted into the openings 38*a* and 38*b*. Thereby, the leaf spring 38 is, in its lower end portion, secured to the front plate 31. That is, the leaf spring 38 is supported on the front plate 31 in a cantilever fashion with its lower end being fixed.

Figure 4A:
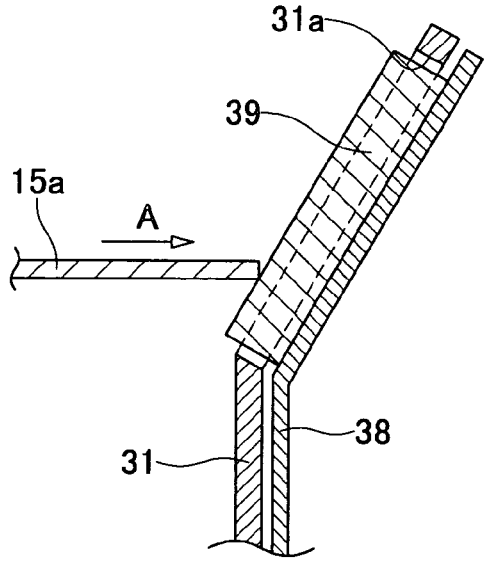
FIGS. 4A and 4B are local sectional views showing stepwise that a paper is conveyed out by the paper feeding mechanism of FIG. 1.

When the leaf spring 38 is supported on the front plate 31, the friction portion 39 protrudes beyond the front plate 31 into the paper storage space of the casing 30 (see FIG. 4A). A face of the friction portion 39 confronting the paper 15 inclines forward. Particularly in this embodiment, the friction portion 39 protrudes from the front plate 31 by approximately 0.5 mm, and inclines approximately 110 to 115 degrees forward with respect to a longitudinal axis of the paper 15 stored in the casing 30.

Figure 4B:
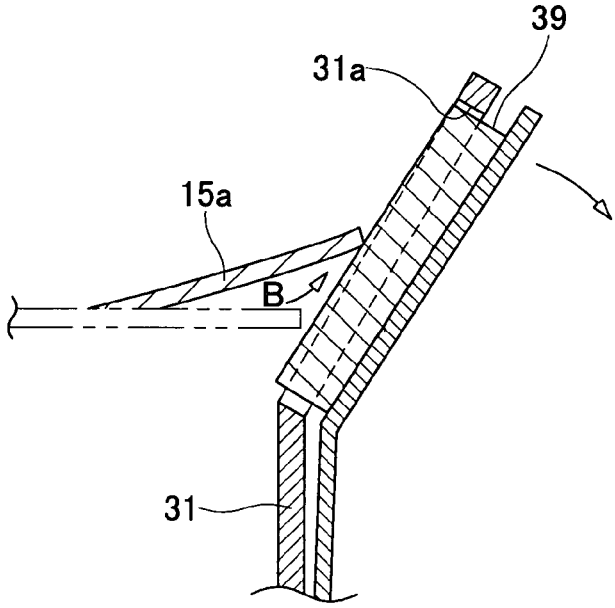

In addition, since the leaf spring 38 is supported in the cantilever fashion as mentioned above, its upper end portion is a free end and therefore elastically displaceable in the direction A. Accordingly, the friction portion 39 held on the upper end portion of the leaf spring 38 is likewise elastically displaceable in the direction A (see FIGS. 4A and 4B).

Further, it can be seen from FIG. 2A that the friction portion 39 is comparatively close to the surface 34*a* of the immovable guide plate 34 that is shown on the downside in the drawing. More specifically, with respect to the direction perpendicular to the direction A, the friction portion 39 is disposed between the surface 34*a* and the center O of the pick-up roller 20 with respect to the direction defined by its rotation shaft 20*a*. Particularly in this embodiment, with respect to the direction perpendicular to the direction A, the friction portion 39 is disposed between the surface 34*a* and a point 2 at which the front plate 31 of the casing 30 intersects with a line that extends perpendicularly to the rotation shaft 20*a* through the center O of the pick-up roller 20 with respect to the direction of the rotation shaft 20*a*.

As illustrated in FIG. 2B, the elevator mechanism 33 provided between the movable base plate 32*a* and the immovable base plate 32*b* includes two flanges 41 and 42, and other two flanges 43 and 44. The two flanges 41 and 42 are mounted on a lower face of the movable base plate 32*a* in a perpendicular manner, and spaced from each other in the lengthwise direction of the paper 15. The two flanges 43 and 44 are mounted on an upper face of the immovable base plate 32*b* in a perpendicular manner, and opposed to the two flanges 41 and 42, respectively. The elevator mechanism 33 further includes two interconnecting members 45 and 46 that connect the diagonally-disposed flanges 42 and 43, and flanges 41 and 44, respectively. The front two flanges 41 and 43 have substantially circular through holes 41*a* and 43*a*, respectively. The rear two flanges 42 and 44 have through holes 42*a* and 44*a*, respectively. The through holes 42*a* and 44*a* are elongated in the lengthwise direction of the paper 15.

One ends of the interconnecting members 45 and 46 are rotatably attached to the front flanges 41 and 43, and the other ends thereof are rotatably attached to the rear flanges 42 and 44, via shafts inserted into the through holes 41*a* to 44*a*, respectively. The shafts inserted into the through holes 42*a* and 44*a* of the rear flange 42 and 44 are movable along the elongations of the holes 42*a* and 44*a*. The two interconnecting members 45 and 46 are at their longitudinal centers, in pivotable connection with each other.

When the shaft inserted into the through hole 44*a* of the flange 44 is moved forward or rearward along the elongation of the hole 44*a*, the movable base plate 32*a* is moved in the direction perpendicular to its plate plane by means of a link mechanism constituted by the flanges 41 to 44 and the interconnecting members 45 and 46.

In order to secure the casing 30 to a chassis 1*a* (see FIG. 2B) of a main body of the printer 1, two connection side plates 61 are provided at both ends of the immovable base plate 32*b* of the casing 30 in the widthwise direction of the paper, as illustrated in FIG. 2A. The connection side plates 61 lie perpendicularly to the base plates 32*a* and 32*b*, and also to the front plate 31.

As illustrated in FIG. 2B, a rear portion of each connection side plate 61 has a substantially rectangular shape so that it can, together with the base plates 32*a* and 32*b* and the front plate 31, define the paper storage space. A front portion of each connection side plate 61 has a substantially triangle shape in which a notch 62, etc., is formed. In the front portion of the connection side plate 61, hook portions 63 and 64 of inverted-L shape are formed over and under the notch 62, respectively. These hook portions 63 and 64 engage with engagement grooves (not illustrated) formed in the chassis 1*a*, so that the casing 30 is secured to the main body of the printer 1.

These connection side plates 61 secure the casing 30 such that the front plate 31, which is not extending in a vertical direction, has its upper end disposed forward and its lower end disposed rearward. Such an inclining placement of the casing 30 facilitates the conveyance of the paper 15*a* with the pick-up roller 20, which will be described later.

FIGS. 2A and 2B also show that the casing 30 has no rear plate and therefore opens out at its rear end. This enables the paper 15 to easily be put through the open rear end into the casing 30.

Next, a construction of the pick-up roller 20 will be described in detail.

The pick-up roller 20 is, via the rotation shaft 20*a*, rotatably supported on a front end portion of an arm 27. The rotation shaft 20*a* is rotated by a non-illustrated driver. The arm 27 is rotatably supported on a shaft 26 that is secured to a suitable member (not illustrated) within the printer 1. The arm 27 has, at its front end, two flanges 27*a* and 27*b* extending therefrom. The pick-up roller 20 is disposed between these flanges 27*a* and 27*b*, and the rotation shaft 20*a* passes through both the flanges 27*a* and 27*b*.

As illustrated in FIG. 2A, a line segment between the center O of the pick-up roller 20 with respect to the direction of the rotation shaft 20*a* and a point P at which the rotation shaft 20*a* intersects with the surface 34*a* of the immovable guide plate 34 forms an acute angle theta, θ, with a line segment extending forward from the point P at which the rotation shaft 20*a* intersects with the surface 34*a* (θ=87° in this embodiment). The shaft 26 of the arm 27 is parallel to the rotation shaft 20*a* of the pick-up roller.

Figure 5A:
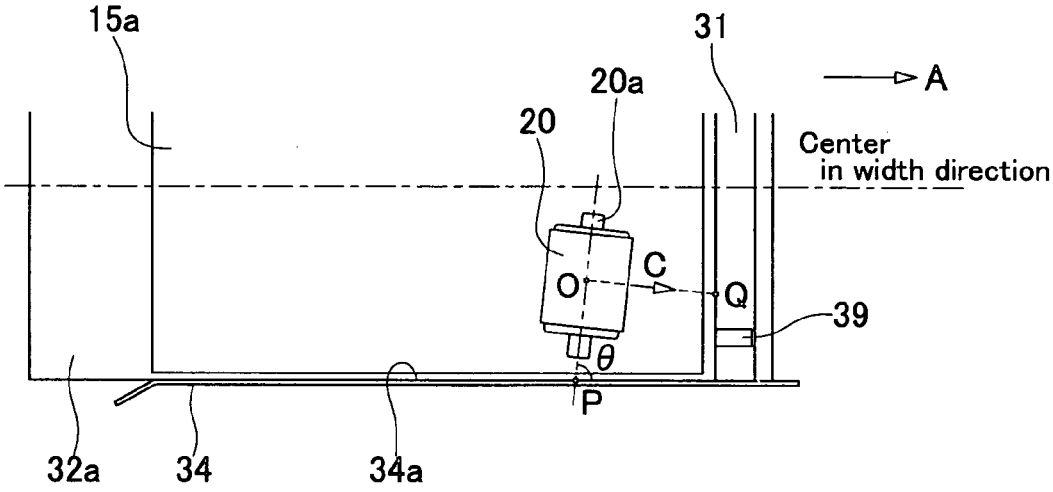
FIGS. 5A and 5B are local top views showing stepwise that a paper is conveyed out by the paper feeding mechanism of FIG. 1.
Figure 5B:
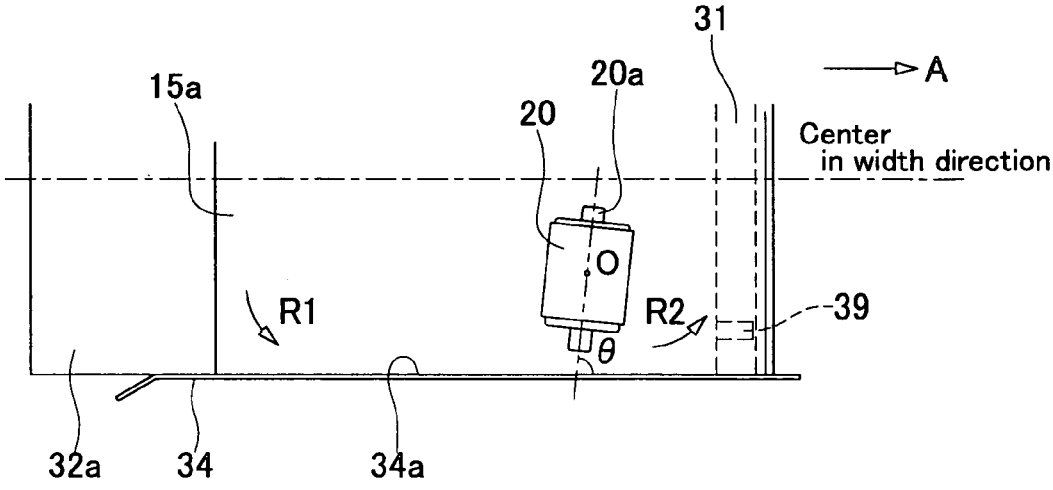

Whichever size, among all the sizes adoptable in the printer 1, a paper 15 has, the pick-up roller 20 is disposed between the surface 34*a* and the widthwise center of the paper 15, i.e., the center of the paper 15 in the direction perpendicular to the direction A (see FIGS. 2A, 5A, and 5B).

Next, referring to FIGS. 4A, 4B, 5A, and 5B, a description will be given to how the pick-up roller 20 of the paper feeding mechanism 70 conveys the paper 15.

The plurality of papers 15 are, prior to being conveyed out by the pick-up roller 20, settled as to their widthwise position to some extent by the guide plates 34 and 35. As illustrated in FIG. 5A, however, one side of the paper 15*a* is slightly spaced from the surface 34*a* of the immovable guide plate 34.

When the pick-up roller 20 starts its rotation while contacting with the surface of the paper 15*a*, the paper 15*a* is firstly conveyed along a direction C that slightly inclines against the direction A. Since the aforementioned theta, θ, is 87 degrees, the direction C which is perpendicular to the rotation shaft 20*a* of the pick-up roller 20, inclines clockwise at 3 degrees against the direction A.

When the pick-up roller 20 starts feeding the paper 15*a*, then immediately a front end of the paper 15*a* becomes in contact with the friction portion 39 (see FIG. 4A). The pick-up roller 20 keeps rotating afterwards. In association with this rotation, the front end portion of the paper 15*a* moves upward, i.e., in a direction B of FIG. 4B, along the inclining face of the friction portion 39, goes over the upper end of the front plate 31, and then arrives onto the conveyor belt 10 (see FIG. 1) of the belt conveyor mechanism 14.

While the front end of the paper 15*a* is thus going over the front plate 31, the front end of the paper 15*a* pushes the friction portion 39 due to toughness of the paper 15*a*, so that the friction portion 39 displaces forward together with the leaf spring 38. Then, when the front end of the paper 15*a* goes beyond the front plate 31, the friction portion 39 and the leaf spring 38 displace rearward into their original positions. That is, the friction portion 39 is, together with the leaf spring 38, displaceable forward and rearward in the direction A in accordance with force applied by the paper 15*a*.

In addition, as illustrated in FIG. 5B, while being conveyed by the pick-up roller 20, the paper 15*a* incurs counterclockwise torque at its center. Accordingly, the front end portion of the paper 15*a* receives force traveling away from the surface 34*a* of the immovable guide plate 34, i.e., force in a direction R2, and the rear end portion thereof receives force traveling toward the surface 34*a*, i.e., force in a direction R1.

However, as described above, immediately after the pick-up roller 20 starts feeding the paper 15*a*, the front end portion of the paper 15*a* becomes in contact with the friction portion 39, and then the paper 15*a* is conveyed on with its back face contacting with the friction portion 39. Thus, friction force, which arises between the paper 15*a* and the friction portion 39, restrains the force in the direction R2 to thereby prevent the front end of the paper 15*a* from moving away from the surface 34*a*. On the other hand, the force in the direction R1 moves the rear end of the paper 15*a* into contact with the surface 34*a*.

As described above, the balance between the friction force caused by the friction portion 39 and the torque occurring in the conveyance operation by the pick-up roller 20 is kept, and thereby the paper 15*a* is moved such that its one side can align along the surface 34*a*. A skew correction is thus implemented. The paper 15*a*, which has been sent out by the paper feeding mechanism 70 in the predetermined conveyance direction A, is pressed onto the conveyor belt 10 by the press roller 5 (see FIG. 1), as described above. Simultaneously with this operation by the press roller 5, the pick-up roller 20 becomes freely rotating, and afterwards the paper 15 is conveyed on by means of driving force of the conveyor belt 10.

As described above, the paper feeding mechanism 70 of this embodiment can pick up and convey the paper 15, and at the same time correct a skew of the paper 15. Therefore, there is no need to provide the printer 1 with, in addition to the paper feeding mechanism 70, a skew correction unit that includes a paper conveyance path required for a skew correction. Thus, the printer 1 can be downsized.

Since the pick-up roller 20 is disposed between the surface 34*a* and the widthwise center of the paper 15, i.e., the center of the paper 15 in the direction perpendicular to the direction A, a skew correction accompanying the conveyance by the pick-up roller 20 can be performed quickly. Consequently, the paper feeding mechanism 70 is adaptable to a high-speed conveyance.

Moreover, the paper feeding mechanism 70 comprises the friction portion 39 having a higher coefficient of friction against the paper 15 than that of the surface 34*a* of the immovable guide plate 34. Thereby, a multi-feeding of the papers 15 can be avoided. For example, even in a case where the pick-up roller 20 conveys out, at one time, a plurality of papers 15 that remain stacking due to, e.g., static electricity generated therebetween, the friction portion 39 hinders a further movement of, among the plurality of papers 15, a paper out of contact with the pick-up roller 20. Thus, the paper out of contact with the pick-up roller 20 is separated from the paper 15*a* that is in contact with the pick-up roller 20. This enables only the paper 15*a* contacting with the pick-up roller 20 to be conveyed onto the conveyor belt 10 (see FIG. 1).

As seen from FIG. 5B, a portion of the paper 15 between the surface 35*a* of the movable guide plate 35 (see FIG. 2A) and its widthwise center is firstly moved rearward by the counterclockwise torque. Therefore, when, for example, the friction portion 39 is disposed between the surface 35*a* and the widthwise center of the paper 15, the front end of the paper 15*a* around the friction portion 39 is firstly moved rearward away from the friction portion 39. In such a case, the paper 15*a* is not brought into contact with the friction portion 39 so immediately after the pick-up roller 20 starts feeding the paper 15*a*. This causes difficulty in quick skew correction. In addition, the force in the direction R2 cannot adequately be restrained, possibly causing a problem that one side of the paper 15*a* is, in its rear portion, rolled upward along the surface 34*a* of the immovable guide plate 34.

On the other side, in this embodiment, with respect to the direction perpendicular to the direction A, the friction portion 39 is disposed between the surface 34*a* of the immovable guide plate 34 and the widthwise center of the paper 15, as illustrated in FIGS. 5A and 5B. This can realize a quick skew correction, and at the same time prevent the aforementioned rolling-up of the paper. Since a quick skew correction is realized, a high-speed conveyance becomes acceptable.

In order to improve the quick skew correction and the prevention of the rolling-up of the paper, it is preferable, as in this embodiment, to dispose the friction portion 39 between the surface 34*a* of the immovable guide plate 34 and the center O of the pick-up roller 20 with respect to the direction of the rotation shaft 20*a*. Further, it is more preferable to dispose the friction portion 39 between the surface 34*a* and the point O at which the front plate 31 of the casing 30 intersects with the line that extends perpendicularly to the rotation shaft 20*a* through the center O of the pick-up roller 20 with respect to the direction of the rotation shaft 20*a*.

The face of the friction portion 39 confronting the paper 15 inclines forward. Therefore, when the pick-up roller 20 conveys the paper 15*a*, the front end of the paper 15*a* becomes in contact with the friction portion 39, and then immediately is moved along the inclining face of the friction portion 39. This can prevent the front end of the paper 15*a* from being damaged by its contact with the friction portion 39.

Further, the friction portion 39 is displaceable forward in the direction A, so that the front end of the paper 15*a* under conveyance pushes the friction portion 39 which then displaces forward. This provides more effective prevention of the damage to the front end of the paper 15*a*. Additionally, since, like this, the friction portion 39 is displaceable forward in the direction A, the friction portion 39 can protrude beyond the front plate 31 to a larger extent, and at the same time the paper 15 used can cover a wider range of thickness.

Moreover, the friction portion 39 is elastically displaceable, so that it elastically returns into the original position when the front end of the paper 15*a* goes over the front plate 31. Accordingly, the paper feeding mechanism 70 is also adoptable for the purpose of sequentially conveying the plurality of papers 15 supported within the casing 30. Thus, when the papers 15 conveyed out one after another become in contact with the friction portion 39, the friction portion 39 always takes the same position and exhibits the same effects with respect to whichever one of those papers 15.

Further, the friction portion 39 is held on the elastic leaf spring 38, and displaceable along with an elastic deformation of the leaf spring 38. Such a relatively simple structure can nevertheless enable the friction portion 39 to elastically displace in the direction A as mentioned above.

A shape of the leaf spring 38 is not limited to the one described in the above embodiment.

It is not always required that the friction portion is 39 is held on the leaf spring 38. The friction portion 39 can be held on the front plate 31 or other members.

In addition, the friction portion 39 may not necessarily be displaceable in the direction A, and its face confronting the paper 15 may not incline forward.

A position of the friction portion 39 is not limited to the aforementioned one, and the friction portion 39 may be disposed between the surface 35*a* of the movable guide plate 35 and the widthwise center of the paper 15, for example.

The number of the friction portion 39 may be, instead of one, two or more, or alternatively the friction portion 39 can be omitted. When two or more friction portion 39 are employed, the same effects as mentioned above can be obtained by disposing one of them in the position described in the above embodiment.

A position of the pick-up roller 20 is not limited to the aforementioned one, either.

The guide plates 35 and 36, other than the guide plate 34, can be omitted.

Not only the above-described casing 30 that forms the paper storage apace but also, e.g., a single plate can be adopted as an element capable of supporting the papers 15 in a stacked manner.

The number of heads to be included in the printer is not limited to four, and the printer is not limited to a color printer.

The sheet feeding mechanism of the present invention can be applied to both serial-type printers and line-type printers as in the above embodiment. The present invention is applicable not only to ink-jet printers, but also to recording apparatuses such as thermal printers, dot printers, and laser printers. Further, the present invention is also applicable to other recoding apparatuses such as facsimile machines or copying machines, instead of printers. Still further, the present invention can be applied to apparatuses other than recording apparatuses, too.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A sheet feeding mechanism comprising:

a sheet supporter capable of supporting a plurality of sheets in a stacked manner;

a pick-up roller that rotates while contacting with a surface of, among the plurality of sheets supported by the sheet supporter, an endmost sheet in an stacking direction, to thereby pick up and convey the sheet;

a guide having a surface that extends along a predetermined conveyance direction for the sheet; and a friction portion having a higher coefficient of friction against the sheet than that of the surface of the guide, the friction portion being contactable with the sheet that is under conveyance by the pick-up roller, wherein a line segment, between a center of the pick-up roller with respect to a direction of a rotation axis of the pick-up roller and a point at which the rotation axis intersects with the surface of the guide, forms an acute angle with a line segment extending forward in the predetermined conveyance direction from the point at which the rotation axis intersects with the surface of the guide, wherein the friction portion is disposed within a forepart of the sheet supporter in the predetermined conveyance direction and, with respect to a direction perpendicular to the predetermined conveyance direction, disposed only between the surface of the guide and a center of the sheet in the direction perpendicular to the predetermined paper conveyance direction, and wherein the friction portion is elastically displaceable in the predetermined conveyance direction.

2. The sheet feeding mechanism according to claim 1, wherein the pick-up roller is disposed only between the surface of the guide and the center of the sheet in the direction perpendicular to the predetermined paper conveyance direction in such a manner that the pick-up roller can be in contact with the surface of the endmost sheet in the stacking direction.

3. The sheet feeding mechanism according to claim 1, wherein, with respect to the direction perpendicular to the predetermined conveyance direction, the friction portion is disposed only between the surface of the guide and the center of the pick-up roller with respect to the direction of the rotation axis of the pick-up roller.

4. The sheet feeding mechanism according to claim 1, wherein, with respect to the direction perpendicular to the predetermined conveyance direction, the friction portion is disposed only between the surface of the guide and a point at which a front end of the sheet supporter in the predetermined conveyance direction intersects with a line that extends perpendicularly to the rotation axis through the center of the pick-up roller with respect to the direction of the rotation axis.

5. The sheet feeding mechanism according to claim 1, wherein a face of the friction portion confronting the sheet inclines forward in the predetermined conveyance direction.

6. The sheet feeding mechanism according to claim 1, wherein the friction portion is displaceable at least forward in the predetermined conveyance direction.

7. The sheet feeding mechanism according to claim 1, wherein the friction portion is held on one end of an elastic leaf spring which is fixed, at the other end thereof opposite to the one end, to a front end of the sheet supporter in the predetermined conveyance direction so that the friction portion is elastically displaceable in the predetermined conveyance direction.

8. The sheet feeding mechanism according to claim 1, wherein the friction portion is contactable with a surface of the sheet opposite to the surface that contacts with the pick-up roller.

* * * * *